US008337371B2

(12) United States Patent
Vollmer, Jr.

(10) Patent No.: US 8,337,371 B2
(45) Date of Patent: Dec. 25, 2012

(54) METHOD AND HANDS-FREE APPARATUS FOR MUSCLE ISOLATION DURING WEIGHT LIFTING EXERCISE

(76) Inventor: David L. Vollmer, Jr., Birdsboro, PA (US)

( * ) Notice: Subject to any disclaimer, the term of this patent is extended or adjusted under 35 U.S.C. 154(b) by 0 days.

(21) Appl. No.: 12/969,624

(22) Filed: Dec. 16, 2010

(65) Prior Publication Data

US 2011/0160025 A1 Jun. 30, 2011

Related U.S. Application Data

(60) Provisional application No. 61/291,581, filed on Dec. 31, 2009.

(51) Int. Cl.
*A63B 21/00* (2006.01)

(52) U.S. Cl. ..... 482/126; 482/124; 482/130

(58) Field of Classification Search ..... 482/126, 482/121, 124

See application file for complete search history.

(56) References Cited

U.S. PATENT DOCUMENTS

| | | | | | |
|---|---|---|---|---|---|
| 2,498,006 | A | * | 2/1950 | Ridill | 473/217 |
| 4,273,328 | A | * | 6/1981 | Ozbey et al. | 482/124 |
| 4,685,671 | A | | 8/1987 | Hagerman et al. | |
| 4,815,731 | A | * | 3/1989 | Suarez et al. | 482/124 |
| 4,911,434 | A | | 3/1990 | Herring | |
| 5,086,762 | A | | 2/1992 | Chee | |
| 5,322,409 | A | | 6/1994 | McCluney | |
| 5,490,826 | A | * | 2/1996 | Rose | 482/74 |
| 5,626,544 | A | | 5/1997 | Foresto | |
| 5,683,336 | A | * | 11/1997 | Pape | 482/124 |
| 5,695,437 | A | | 12/1997 | Olschansky et al. | |
| 5,704,856 | A | * | 1/1998 | Morse | 473/422 |
| 5,807,218 | A | * | 9/1998 | Nagatomo | 482/124 |
| 5,848,956 | A | | 12/1998 | Grettner | |
| 5,860,944 | A | | 1/1999 | Hoffman, Jr. | |
| 6,168,556 | B1 | | 1/2001 | Saavedra | |
| 6,322,482 | B1 | | 11/2001 | Kim | |
| 6,540,651 | B1 | | 4/2003 | Aberton et al. | |
| 6,565,493 | B1 | | 5/2003 | Geh | |
| 6,616,581 | B2 | | 9/2003 | Gwyn | |
| 7,165,511 | B1 | * | 1/2007 | Brezinski | 119/792 |
| 7,537,547 | B1 | | 5/2009 | Hosick et al. | |
| 2003/0040408 | A1 | * | 2/2003 | Cooper, Sr. | 482/124 |
| 2005/0043150 | A1 | | 2/2005 | Nitta et al. | |
| 2006/0229175 | A1 | | 10/2006 | Frappier | |
| 2007/0089380 | A1 | * | 4/2007 | Bechtold | 54/24 |
| 2009/0209396 | A1 | | 8/2009 | Ferguson | |
| 2009/0312683 | A1 | | 12/2009 | Burns | |

FOREIGN PATENT DOCUMENTS

| | | | |
|---|---|---|---|
| CA | 1102370 | A1 | 6/1981 |
| WO | 2006098986 | A1 | 9/2006 |

* cited by examiner

*Primary Examiner* — Jerome W Donnelly
(74) *Attorney, Agent, or Firm* — Andrew D. Mead

(57) ABSTRACT

An exercise apparatus comprising two adjustable cuffs configured to encircle a user's extremity on either side of an articulated joint, such as the elbow. Each cuff is provided with a connector ring for conveniently connecting a pull line to a weight machine, suspended free weight, or other resistance generating exercise machine. One or both connector rings may be engaged by the pull line. The two connector rings are interconnected by an adjustable-length isolator strap which limits the range of motion of the user's elbow. By isolating arm movement, the apparatus enables isolated exercise of chest, shoulder, or back muscle groups. As hands are not necessary, the apparatus also enables users having a hand or other lower arm infirmity to continue other upper-body muscle exercises.

15 Claims, 4 Drawing Sheets

METHOD AND HANDS-FREE APPARATUS FOR MUSCLE ISOLATION DURING WEIGHT LIFTING EXERCISE

CROSS-REFERENCE TO RELATED APPLICATIONS

This application claims the benefit of priority of U.S. Provisional Application 61/291,581, filed Dec. 31, 2009.

BACKGROUND OF THE INVENTION

This invention relates generally to exercise equipment, and more particularly to a method and apparatus enabling hands-free weight lifting exercise of several specific muscle groups in isolation, specifically muscles in the chest, shoulders, and back.

Weight lifting exercises targeting the upper body often rely on a user's hands to provide the connection between the body and the weight or resistance machine. Consequently, hand injuries usually require the injured person to suspend weight-lifting exercise while the injuries heal. In cases where the hand injury is permanent, the person may be forced to abandon certain weight lifting exercises requiring use of the hands altogether.

Other weight lifting exercises exist to isolate individual muscles or specific groups of muscle enabling targeted development of the muscle. The objective of such specific exercise is often related to body building with the goal of maximizing individual muscle definition. Many upper body exercises in which the hands provide the human-machine connection provide only limited muscle isolation capability; arm movement typically involves many muscles in the arms, chest, and back.

It would be advantageous to have an apparatus and a method for using the apparatus that would allow a user hand-free interaction with weights or a weight-resistance machine in a manner enabling continuation of an upper body exercise regime. Additional advantages would be derived from the above apparatus if it could be conveniently used by any user in weight lifting exercise, regardless of any hand infirmity that might exist.

SUMMARY OF THE INVENTION

Accordingly, the present invention, in any of the embodiments described herein, may provide one or more of the following advantages:

It is an object of the present invention to provide an apparatus to be worn by a user that enables hand-free weight-lifting exercise of pre-selected muscle groups in the chest, shoulders, and back. The apparatus comprises first and second cuffs configured to encircle the user's bleep and forearm, respectively. Each cuff includes a structure for connecting the apparatus to a resistance device or weight.

It is another object of the present invention to provide a hands-free weight-lifting apparatus for a user that may be selectively adjusted to fit a wide array of user physiques. The cuffs are selectively adjustable in circumference to fit a typical range of human arm sizes. The cuffs also incorporate elastic portions to maintain pressure contact with the user's arm once donned to limit movement of the apparatus along the length of the arm.

It is another object of the present invention to provide a hands-free weight-lifting apparatus that may be used to limit the range of motion of a user's arm in order to isolate specific muscle groups for exercise. The first and second cuffs are further interconnected by an adjustable connector which limits the distance separating the cuffs and thus limits the angle between forearm and upper arm (humerus) to a maximum extension (straightening) and thus enables the apparatus to be tailored for the needs of each individual user.

It is further object of the present invention to provide a weight-lifting exercise apparatus that enables isolated exercise of pre-selected muscle groups in the user's chest, shoulders, or back while limiting exertion of the user's arm muscles. The apparatus benefits users seeking targeted exercise of specific muscles and/or muscle groups in the chest, shoulders, and back and is easily adaptable for use on a variety of exercise apparatus commonly found in gyms.

It is a still further object of the present invention to provide a weight-lifting exercise apparatus that enables users lacking the ability to grasp with their hands to engage in upper-body weight-lifting activity.

It is a still further object of the present invention to provide a hands-free, upper-body weight-lifting apparatus that is durable in construction, inexpensive of manufacture, carefree of maintenance, easily assembled, and simple and effective to use.

These and other objects are achieved by an exercise apparatus comprising two adjustable cuffs configured to encircle a user's arm on either side of the elbow. Each cuff is provided with a connector ring for conveniently connecting a pull line to a weight machine, suspended free weight, or other resistance generating exercise machine. One or both connector rings may be engaged by the pull line. The two connector rings are interconnected by an adjustable-length isolator strap which limits the range of motion of the user's elbow. By isolating arm movement, the apparatus enables isolated exercise of chest, shoulder, or back muscle groups. As hands are not necessary, the apparatus also enables users having a hand or other lower arm infirmity to continue other upper-body muscle exercises.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "up" or "down" or "top" or "bottom" are used as a matter of mere convenience, and are determined when viewing the invention as it would normally be worn by a user while standing. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures.

Figure 1:
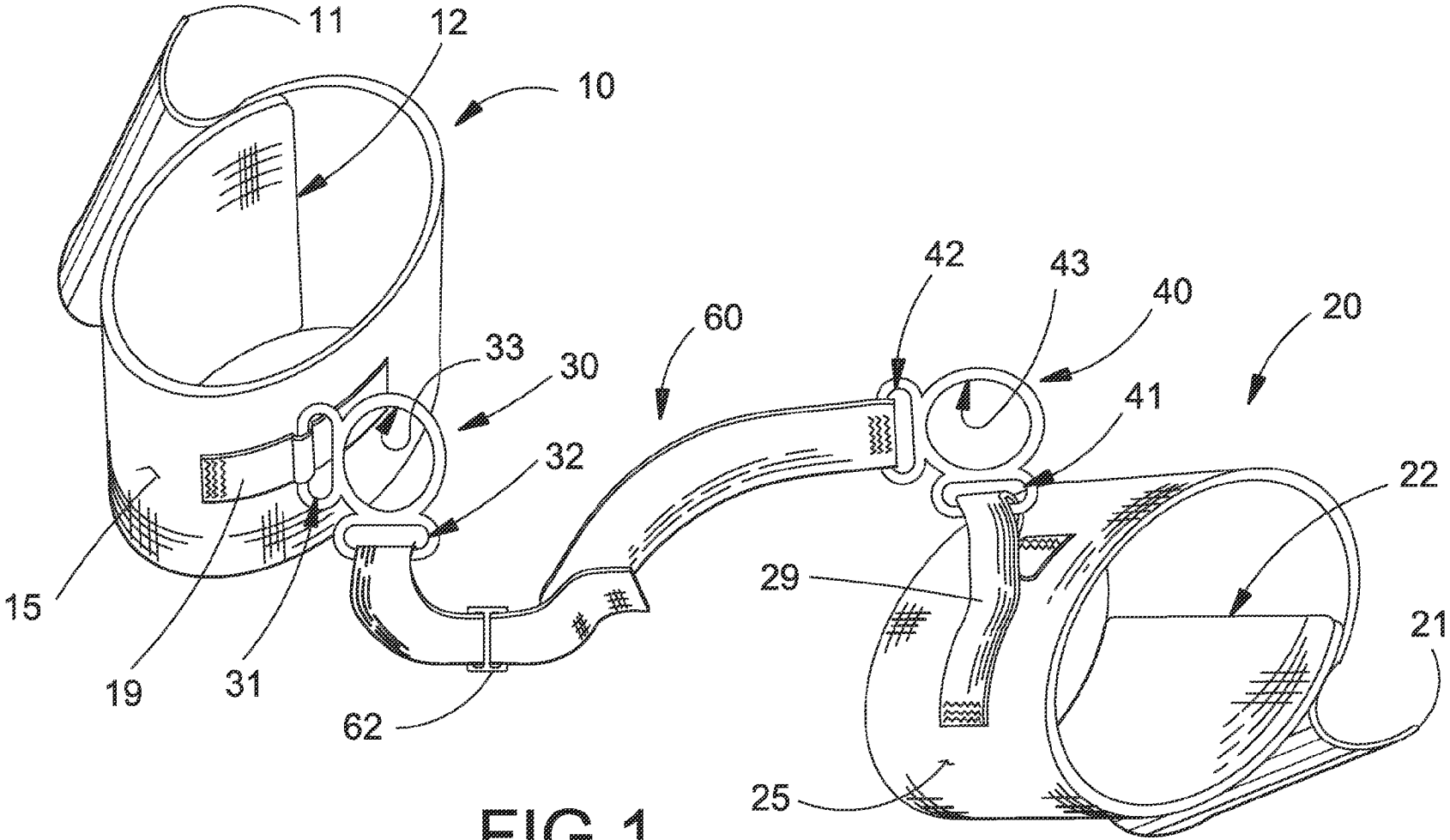
FIG. 1 shows one embodiment of the hands-free, muscle-isolating exercise device of the present invention.

Referring to FIG. 1, one embodiment of the muscle isolation exercise apparatus 5 is shown having a first adjustable upper cuff 10 and a second adjustable lower cuff 20. Each cuff is preferably made from a nylon webbing material of sufficient strength to withstand the lifting forces being applied and provide reasonable durability. The width of each cuff is on the order of three inches to improve user comfort by minimizing pressure applied on the arm by each cuff. In the embodiment shown, each cuff comprises an elongate section of webbing material 15, 25, each having two opposing ends, 11, 12, 21, 22, respectively. The cuffs are looped around the user's arm in two positions, the upper cuff 10 encircling the user's bicep (humerus) and the lower cuff 20 encircling the user's forearm, and adjusted so that the inside circumference of each cuff closely matches the circumference of the user's arm thus securely engaging the cuff around the user's arm by friction between the cuff and the arm. The secure fit ideally will allow alight flexure of the arm and blood flow, but prevent the cuff from significantly moving axially along the arm to a degree that would frustrate the user's exercise movements. The circumference of each cuff may be fixed to the arm by the inclusion of a closure means, such as a strap end and buckle, a strap and O-ring combination, or a hook-and-loop fastening material (e.g., Velcro®) connection for precise adjustability. Elastic material may be incorporated into the strap to maintain a slight tension in the cuff circumference to further secure the cuff to the user's arm. A pneumatic bladder incorporated within the cuff could also serve as a means to secure the cuff in a fixed relation to the user's arm. Alternatively, each cuff may be formed from a continuous loop of an elastic material; however, such an approach limits the range of arm sizes that can be accommodated by a single apparatus and is therefore not preferred. Ideally, each cuff will incorporate a portion of elastic material to provide limited variation in the cuff circumference once the circumference is fixed by the closure means to improve user comfort and allow flexure of the arm muscles. Incorporation of the elastic portion is not essential to the cuff functionality.

To each cuff is connected an attachment ring (upper attachment ring 30 and lower attachment ring 40 connected to upper and lower cuffs 10, 20, respectively). Each attachment ring is preferably a two-sided halter square having a pair of orthogonally oriented strap apertures 31, 32, 41, 42, respectively, and a larger ring opening 33, 43. The first strap apertures 31, 41 provide a convenient means for attaching the attachment rings 30, 40 to their respective cuff, preferably using webbing material approximately one inch in width (illustrated as 19, 29 in FIG. 1) stitched to the exterior of the cuff to provide sufficient strength. The attachment of the lower attachment ring 40 to the lower cuff 20 preferrably includes a length of webbing material 29 sufficient to enable attachment ring 40 to be positioned slightly away from the outer surface of the lower cuff 20, preferably between one and three inches. The upper attachment ring 30 in comparison is attached directly to the outer surface of the upper cuff 10 by attachment strap 19. The separation of the lower attachment ring 40 from the lower cuff 20 better positions the ring opening 43 for exercise. The ring openings 33, 43 provide a structure for connecting by carabineer or similar connector a weight or a tension member for a weight resistance machine. The second strap apertures 32, 42 are provided to enable an adjustable strap of webbing material to span between the upper and lower cuffs, connected to the second strap aperture of each attachment ring. This isolator strap 60 benefits the user by restricting the movement of the elbow joint and thus the force contribution of the biceps/triceps during certain exercises. Isolator strap 60 is adjustable in length between the upper and lower attachment rings 30, 40 so that maximum elbow extension may be individually selected for each user. To this end, an adjuster device 62 is provided so that the length of isolator strap 60 may be selectively established by the user.

The exercise apparatus may be used in a variety of ways as illustrated in FIGS. 2 through 6. The user first dons the apparatus on the arm to be exercised by positioning the apparatus so that the upper cuff encircles the user's bicep while the lower cuff 20 encircles the user's forearm. A second apparatus may be used to allow simultaneous exercise of both arms. The cuffs 10, 20 are then oriented on the arms so that the attachment rings 30, 40 face the direction from which the resistance is to be applied. Resistance is preferably applied by connecting a weight 100 or an equivalent resistance-generating exercise machine to the user by a tension connector 110 to span between the resistance and the desired attachment ring 30, 40. A removable connector, such as a carabineer 112, allows the tension connector to be easily attached to the apparatus. Depending on the particular exercise to be performed, the length of the isolator strap 60 may then be adjusted to achieve the desired limitation of elbow flexure.

Figure 2:
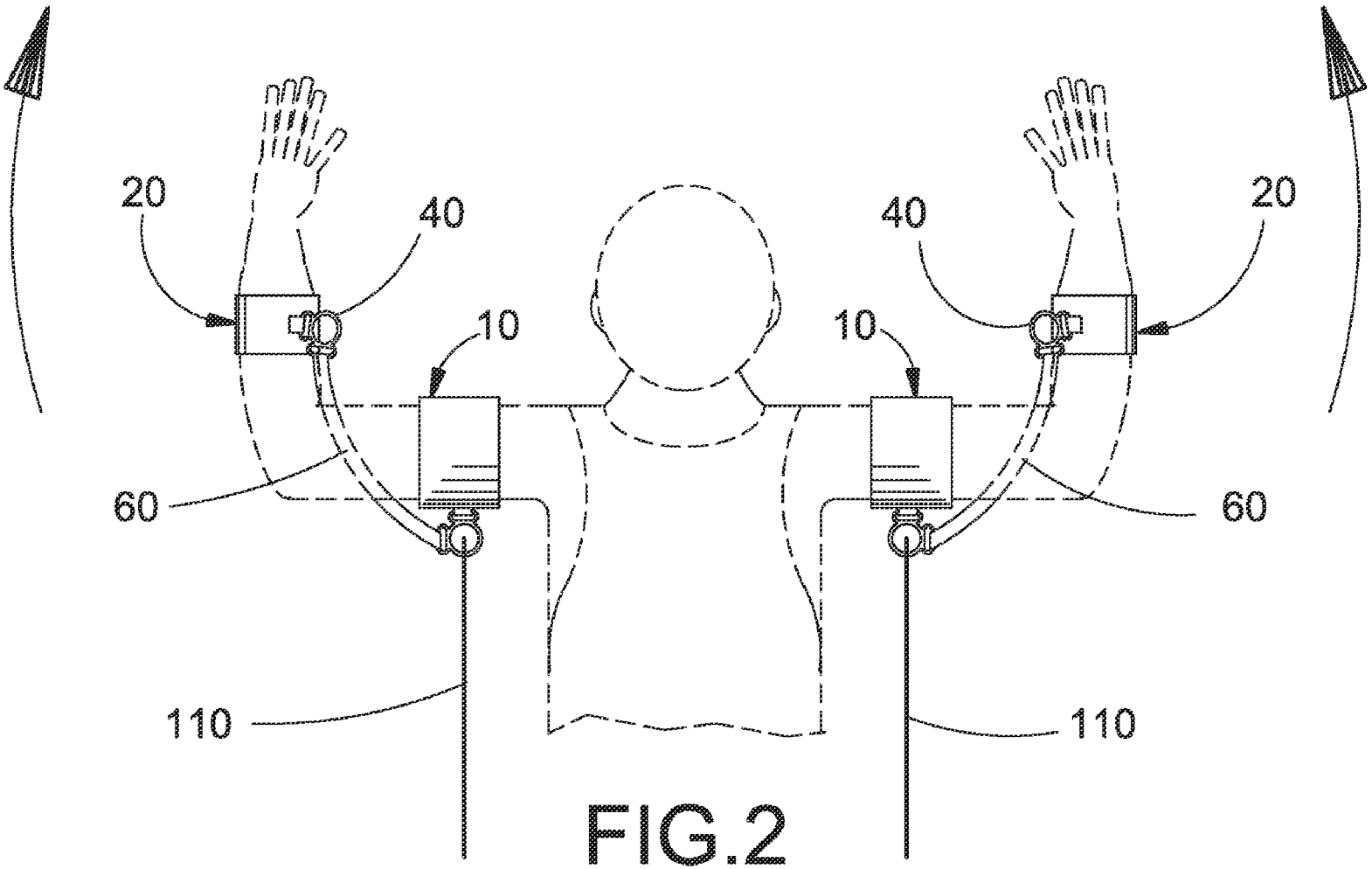
FIG. 2 shows a user of the hands-free exercise devise of the present invention engaged in an upward arm movement exercise.
Figure 3:
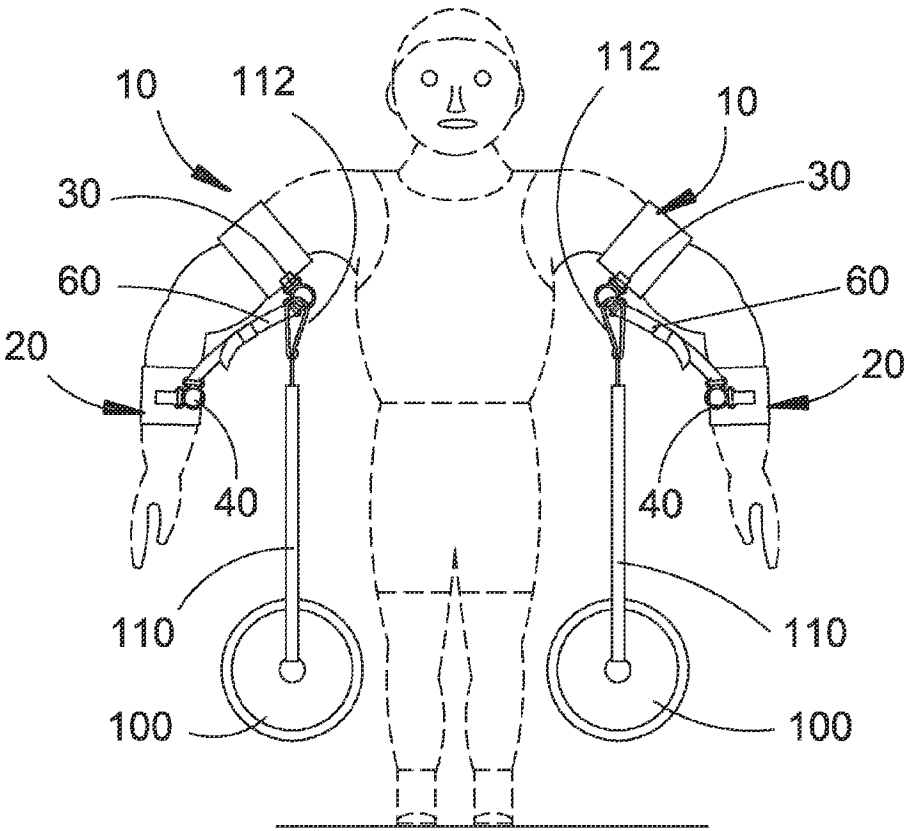
FIG. 3 shows an alternate view of the user in FIG. 2.

To perform exercises in which resistance is encountered as the arms are raised (e.g., chest and shoulders), the cuffs 10, 20 are rotated on the user's arms until the attachment rings 30, 40 are positioned on the arm adjacent to the triceps and the forearm extensor muscles on the arm. The resistance is connected to first attachment ring 30 and adjusting the isolator strap 60 snug between the upper cuff 10 and the lower cuff 20 with the elbow in a comfortably bent position. The isolator strap 60 also distributes the force of the resistance between the two cuffs for improved comfort. This exercise setup is illustrated in FIG. 2. A similar exercise is illustrated in FIG. 3. Note that the attachment rings 30, 40 will be generally oriented toward the direction from which the resistance is applied.

Figure 4:
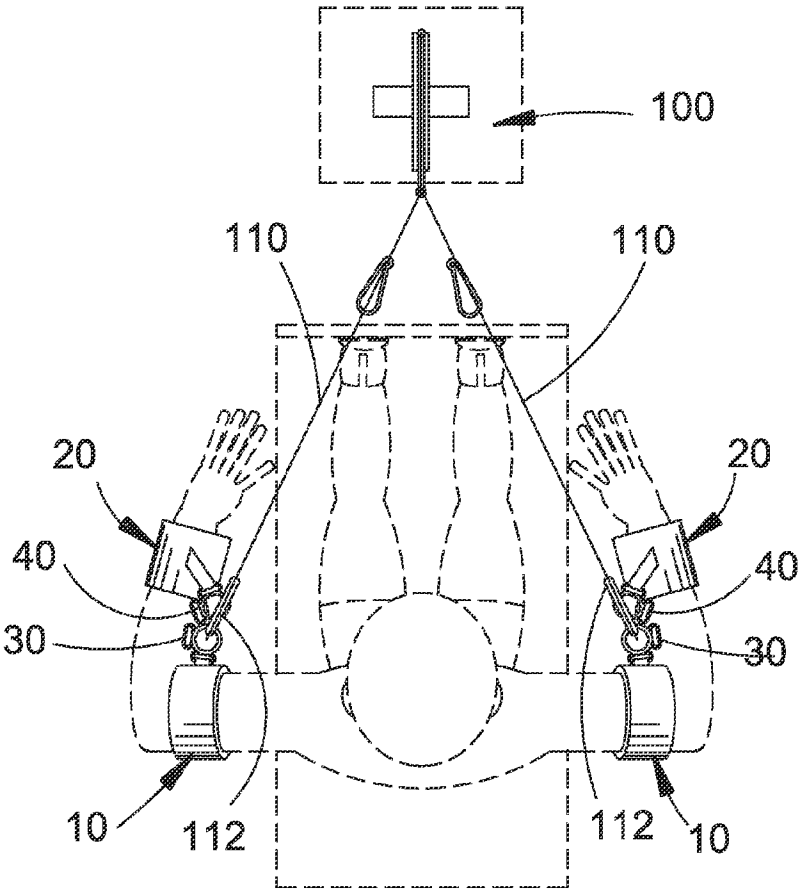
FIG. 4 shows a user of the hands-free exercise device of the present invention engaged in a rearward arm movement exercise.

Referring to FIG. 4, exercises in which the direction of force application extends from the front of the body (e.g., back muscles) require the attachment rings 30, 40 to be positioned adjacent to the anterior portion of the arms adjacent to the biceps and forearm flexor muscles. The isolator strap 60 is shortened to the minimum length extent possible in order to maintain the arm(s) in a bent position. Alternatively, the first and second attachment rings 30, 40 may then be simultaneously engaged by a single carabineer to connect to the exercise resistance (weight or machine). Attaching the resistance to the lower attachment ring 40 alone extends the effective force moment arm, increasing exercise effort for a given resistance.

Figure 6:
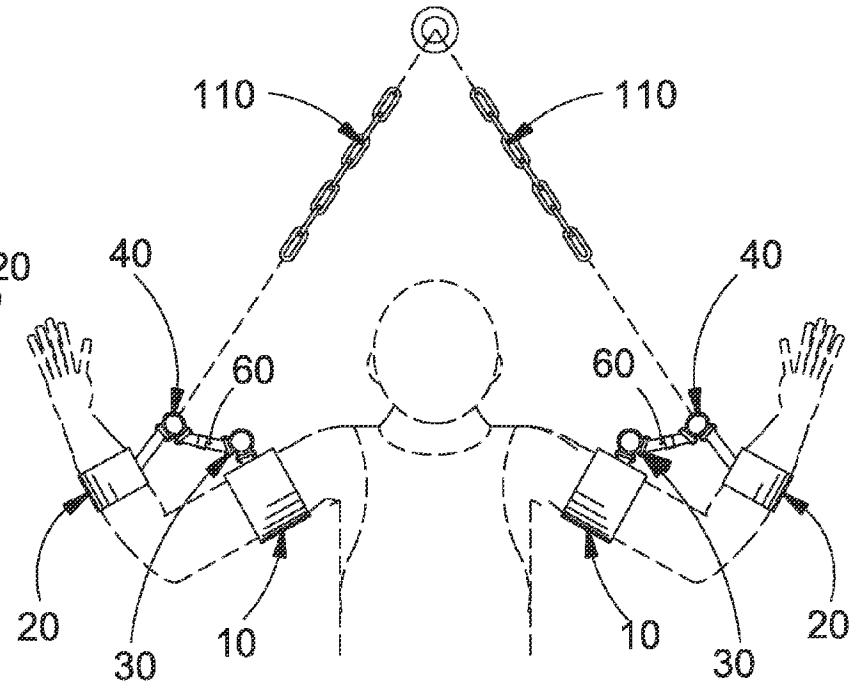
FIG. 6 shows a user of the hands-free exercise device of the present invention in a second position of a downward arm movement exercise.
Figure 5:
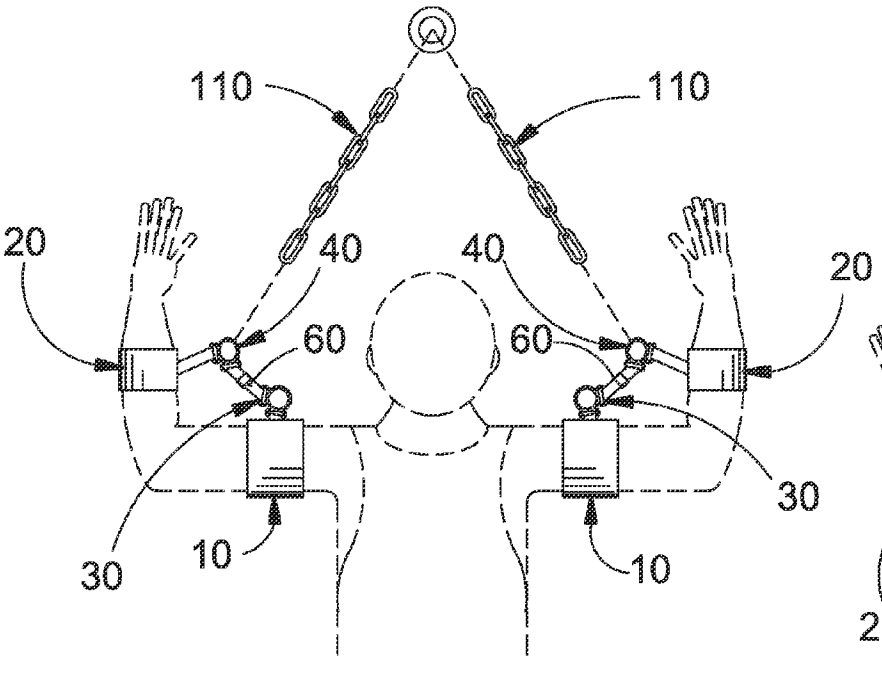
FIG. 5 shows a user of the hands-free exercise device of the present invention in a first position of a downward arm movement exercise.

Finally, referring to FIGS. 5 and 6, an exercise in which the resistance is applied from above and the user pulls downwardly is illustrated. Exercises of this nature require the cuffs 10, 20 to be positioned so that the attachment rings 30, 40 are positioned upwardly in the direction from which resistance is applied. Attachment of the tension connectors 110 to either the first or second attachment rings 30, 40 allows different muscle groups to be exercised. Connecting to the lower attachment ring 40 provides greater leverage for the user and enables a greater degree of movement during the exercise.

The exercise apparatus 5 is beneficial for users having injuries which otherwise prevent upper body exercise. Such injuries include injuries or complications from an injured bicep, broken hand, finger or wrist, carpal tunnel, tendonitis, weak hands, wrist or forearms, and shoulder issues. Conventional exercise motions of most upper-body exercises while isolating the hands, wrist, forearm, bicep and triceps allowing isolation of primary muscle groups of the chest, back and shoulders. Furthermore, the exercise apparatus provides comparable exercise benefit requiring approximately half of the weight or resistance the user would normally use in a given exercise. This in turn decreases the pressure on joints, tendons and ligaments and reduces the risk of further injury during the convalescence from the initial injury.

The exercise apparatus 5 may also benefit users in the body building profession where isolating large muscle groups is essential to maximizing one's physique. The exercise apparatus 5 allows target exercise of major muscle groups without relying on secondary muscle groups during the particular exercise. In one exercise, triceps, hands and forearms may be isolated from chest and shoulder exercises. Biceps may also be isolated during workouts of the back muscles. Rather than being limited by the weakest muscles in the line of force transfer, the exercise apparatus 5 allows isolated muscle groups to be exercised to their fullest potential. One such example is the limitation of the biceps during back exercises. Athletes may similarly benefit by the ability to target specific muscle groups for exercise.

While the above description uses arms as the extremity to be exercised, the invention is also adaptable for use on a person's legs. Such application would benefit a user having a lower leg injury, such as an ankle injury, which could prevent interaction with certain conventional lower body exercise apparatus.

Naturally, the invention is not limited to the foregoing embodiments, but it can also be modified in many ways without departing from the basic concepts. Changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

I claim:

1. An apparatus for connection to weight-lifting exercise device enabling hands-free operation of the exercise device by a user comprising:

a first cuff configured to circumferentially engage an arm of the user at a first location adjacent to an elbow joint;

a second cuff configured to circumferentially engage the arm of the user at a second location on an opposite side of the elbow joint;

an elongate, inelastic isolator having a fixable length interconnecting said first cuff and said second cuff in a manner limiting the maximum separation between said first and said second cuffs, said fixable length being selectively adjustable; and a first connector attached to said first cuff and a second connector attached to said second cuff, said connectors each configured for attachment to the exercise device, said isolator limiting the maximum separation between said first and said second cuffs to maintain the elbow joint flexure generally fixed while enabling connection of the exercise device at said first connector or said second connector so that the user may operate the exercise machine without the use of the hands.

2. The apparatus as described in claim 1, wherein said first cuff and said second cuff each have a cuff adjuster enabling a circumference of said cuffs to be individually adjusted to securely conform to the arm of the user thereby retaining each said cuff generally immovably on the user's arm.

3. The apparatus as described in claim 2, wherein each said cuff adjuster comprises a strap and buckle.

4. The apparatus as described in claim 2, wherein each said cuff adjuster comprises and elastic portion biased to maintain said cuffs secured in place on the user's arm.

5. The apparatus as described in claim 2, wherein each said cuff adjuster comprises a hook and loop fastener.

6. The apparatus as described in claim 1, wherein said first and said second connectors are each double square halter rings.

7. An apparatus for enabling hands-free operation of a resistance applying shoulder exercise device by a user comprising:

a first cuff configured to generally circumferentially and immovably engage an arm of the user at a first location adjacent an elbow of the user;

a second cuff configured to generally circumferentially and immovably engage the arm of the user at a second location wherein the elbow is positioned between said first and said second cuffs;

an inelastic, elongate isolator strap having a fixable length interconnecting said first cuff and said second cuff, said fixable length being selectively adjustable by the user, adjustment of which enables maximum separation between said first cuff and said second cuff to be selected to limit extension of the user's elbow to a pre-determined amount; and a first connector attached to said first cuff and a second connector attached to said second cuff, said connectors each configured for attachment to the exercise device and said isolator strap limiting extension of the user elbow joint so that the user may operate the shoulder exercise device without the use of the hands.

8. The apparatus as described in claim 7, wherein said first cuff and said second cuff each have a cuff adjuster enabling a circumference of each said cuff to be individually adjusted to securely conform to the arm of the user.

9. The apparatus as described in claim 8, wherein each said adjuster comprises a strap and buckle.

10. The apparatus as described in claim 8, wherein each said adjuster comprises and elastic portion biased to maintain said cuffs secured in place on the user's arm.

11. The apparatus as described in claim 8, wherein said first and said second connectors are each double square halter rings.

12. The apparatus as described in claim 8, wherein the exercise device has a selectively adjustable resistance.

13. A method for hands-free use of a weight-lifting exercise device comprising the following steps:

providing a first arm cuff configured to circumferentially engage an arm of the user at a first location;

providing a second cuff configured to circumferentially engage the arm of the user at a second location spaced apart from the first location;

providing an elongate, inelastic isolator strap interconnecting the first and second arm cuffs, the isolator having a fixable length, adjustment of which enables separation between the first and second cuffs to be limited to a pre-determined amount;

providing a first connector attached to the first arm cuff and a second connector attached to the second arm cuff, the first and second connectors each configured for attachment to the exercise device in a manner restricting relative movement of the exercise device attachment between said first and second connectors;

engaging, by the user, the first cuff at the first location on the arm adjacent to an elbow joint;

engaging, by the user, the second cuff at the second location on the arm on the opposite side of the elbow joint from the first cuff;

adjusting, by the user, the isolator fixable length to achieve the desired maximum separation between the first and second cuffs; and connecting, by the user, the first connector, the second connector, or the first and the second connector to the exercise device whereby a user may operate the exercise device without the use of the hands.

14. The method of claim 13, further comprising the steps of:

providing an adjuster on each of the first cuff and the second cuff enabling a circumference of the cuffs to be individually adjusted to securely conform to the arm of the user;

providing a tension member for connecting the apparatus to the exercise device; orienting, by the user, the first and second connectors in a direction from which the tension member extends from the exercise device; and adjusting, by the user, the adjusters on the first and second cuffs so that the cuffs securely encircle the users arms.

15. The method of claim 14, wherein the exercise device has a selectively adjustable resistance.

* * * * *